US005770825A

United States Patent [19]

Yamaguchi et al.

[11] Patent Number: 5,770,825

[45] Date of Patent: Jun. 23, 1998

[54] SWITCH DEVICE

[75] Inventors: Kiyotaka Yamaguchi; Hiroyuki Kuroda; Kazuya Yoshikawa, all of Kyoto, Japan

[73] Assignee: Omron Corporation, Kyoto, Japan

[21] Appl. No.: 690,168

[22] Filed: Jul. 26, 1996

[30] Foreign Application Priority Data

Jul. 27, 1995 [JP] Japan ..... 7-212629

[51] Int. Cl.[6] ..... H01H 9/02

[52] U.S. Cl. ..... 200/5 R; 174/250; 200/294

[58] Field of Search ..... 174/250, 255, 174/260, 261, 268; 200/5 R, 5 A, 11 D, 11 DA, 16 R, 17 R, 18, 52 R, 512, 517, 520, 282, 283, 284, 292–294, 339, 341

[56] References Cited

U.S. PATENT DOCUMENTS 3,892,931 7/1975 Lockard ..... 200/11 R
4,764,645 8/1988 Takasawa ..... 200/16 F
4,767,896 8/1988 Nigg et al. ..... 200/67 DA
4,772,761 9/1988 Ibrahim et al. ..... 174/52 FP
4,860,436 8/1989 Hirabayashi et al. ..... 29/622
5,357,230 10/1994 Mikawa ..... 335/78
5,359,164 10/1994 Kucharski, Jr. ..... 200/315

*Primary Examiner*—Michael L. Gellner
*Assistant Examiner*—Michael A. Friedhofer
*Attorney, Agent, or Firm*—Foley & Lardner

[57] ABSTRACT

In a switch device, a metal stamping has a first group of connector terminals arranged in one line among plural lines of arranged connector terminals and is constructed by one metal stamping together with a wiring pattern. The metal stamping is subjected to an insert molding process to form an insert molding. A second group of connector terminals, arranged in another line, among the connector terminals arranged in plural lines, are formed from parts of metal pieces which are separate from the metal stamping. The second group of connector terminals are press-fitted in the insert molding. In the switch device, the manufacture of the metal stamping requires minimal bending steps, and the manufacture can be achieved with the use of a simple stamping metal mold.

8 Claims, 4 Drawing Sheets

SWITCH DEVICE

BACKGROUND OF THE INVENTION

1. Field of the Invention

This invention relates to a switch device which is mainly applied to a motor vehicle.

2. Description of the Prior Art

A switch device is well known in the art which is used, for instance, for operating a power window of a motor vehicle and is mounted on the door beside the driver's seat or the assistant driver's seat, and which is electrically connected through its connector terminals to a load such as an electric motor, which is controlled thereby. The switch device of this type is generally mounted in a narrow space. Hence, it has been a requirement to miniaturize the switch device as much as possible. On the other hand, as the number of switches increases in the switch device, the latter is unavoidably increased in size as a whole, and the number of connector terminals is thereby also increased. In this case, in order to minimize the increase in volume of the switch device, a method has been proposed in which the connector terminals are arranged in two stages (or in two lines), and the connector terminals thus arranged protrude from the bottom of the switch device, or from the front and the rear. The connector terminals are parts of a metal stamping which is formed by stamping a metal plate. The metal stamping is subjected to insert-molding, to provide an insert molding which is to be built in the casing of the switch device.

As described above, in the conventional switch device in which the connector terminals are arranged in two lines, the connector terminals are parts of the metal stamping which is formed by stamping a metal plate, and the metal stamping is subjected to insert-molding, to form the insert molding. Consequently, the switch device suffers from the following difficulties:

(1) The manufacture of the metal stamping requires a large number of bending steps, and accordingly the stamping metal mold is complicated.

(2) Since the manufacture of the metal stamping requires a large number of bending steps, as described above, it creates a number of wasteful portions when unfolded.

(3) Since the connector terminals are arranged in two lines and are inserted into the switch device body, the metal mold is complicated in configuration, and the molding cycle is long.

(4) In the case where there are two kinds of switch devices—a first switch device in which connector terminals are arranged in one line, and a second switch device in which connector terminals are arranged in two lines, it is necessary to form two different moldings respectively for the two kinds of switch devices, which thereby increases the manufacturing cost.

SUMMARY OF THE INVENTION

It is an object of the invention to provide a switch device in which the metal stamping is simplified in configuration, and its stamping metal mold is also simple in configuration, and it has less wasteful portions when unfolded; and in the case where there are two kinds of switch devices—a first switch device in which connector terminals are arranged in one line, and a second switch device in which connector terminals are arranged in two lines, the insert molding formed by subjecting the metal stamping to insert molding can be commonly applied to the first and second switch devices, which contributes to a reduction in the manufacturing cost of the switch devices.

A switch device of the present invention comprises: a plurality of switches which control a plurality of external loads; a casing which accommodates the plurality of switches therein; operating members which operates the plurality of switches appearing in an upper surface of the casing; and a plurality of connector terminals through which the plurality of switches are electrically connected to the external loads, the connector terminals being arranged in plural lines in a lower surface or side surface of the casing; wherein among the connector terminals in plural lines, a first group of connector terminals in one line and a wiring pattern are constructed by one metal stamping, and a second group of connector terminals in other line are constructed by metal pieces different from the metal stamping, the connector terminals being provided to be electrically connected to the wiring pattern, the metal stamping and the metal pieces different therefrom being accommodated in the casing.

In the switch device, among the connector terminals in plural lines, the first group of connector terminals arranged in one line together with the wiring pattern are parts of the one metal stamping, and the second group of connector terminals arranged in another line is a part of metal pieces which are different from the metal stamping, and the metal pieces are electrically connectable to the wiring pattern. That is, in the switch device, the connector terminals in plural lines are made up of the metal stamping and the metal pieces. Therefore, in the switch device of the invention, when compared with the manufacture of the metal stamping of a switch device in which its connector terminals arranged in plural lines are parts of one metal stamping, the manufacture of the metal stamping is less in the number of bending steps, and can be achieved with a simple stamping metal mold.

PREFERRED EMBODIMENTS OF THE INVENTION

Preferred embodiments of the invention will be described with reference to the accompanying drawings.

First Embodiment

Figure 1:
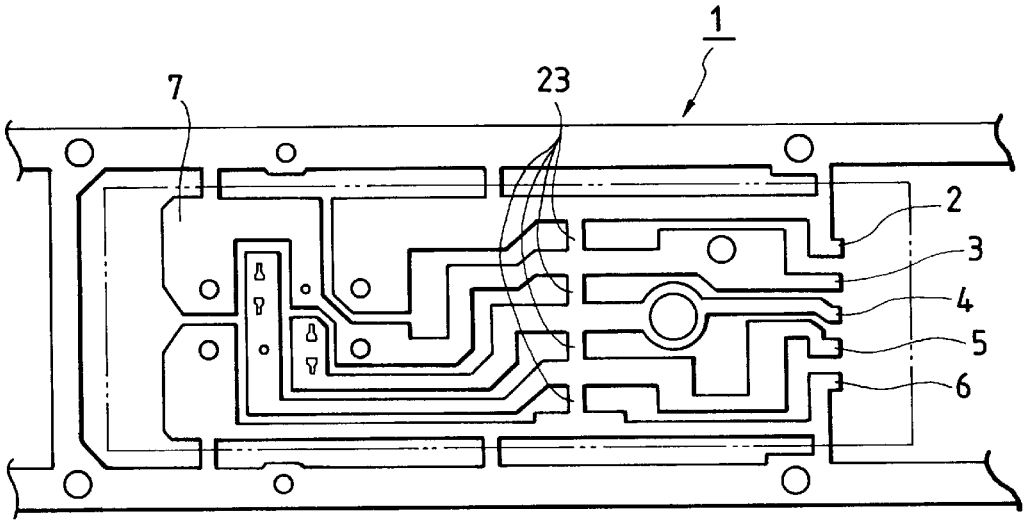
FIG. 1 is a plan view of a metal stamping which is subjected to insert molding, to form an insert molding which is employed in a first embodiment of the invention.
Figure 2:
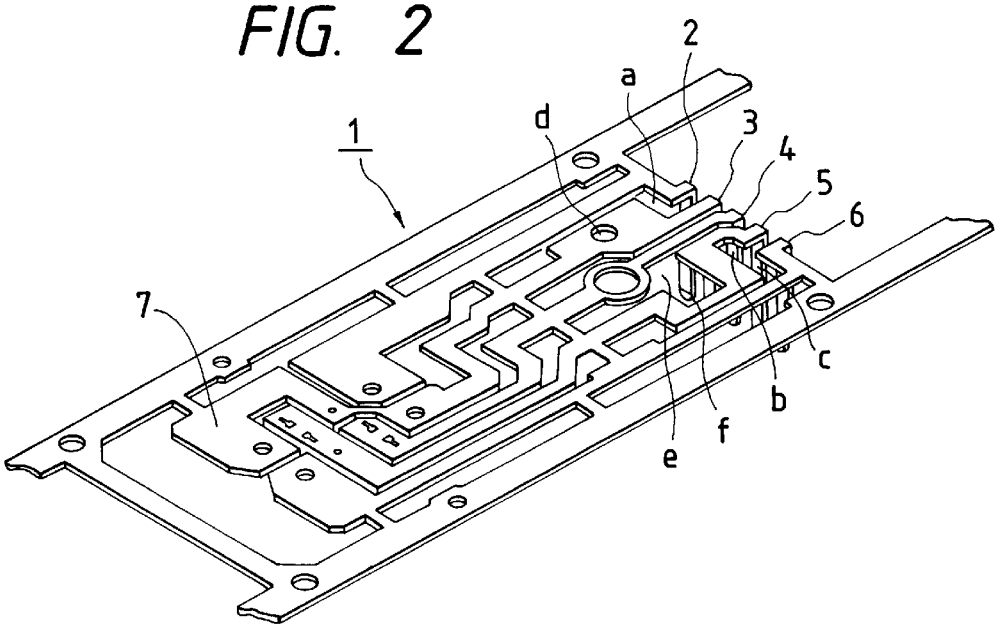
FIG. 2 is a perspective view of the metal stamping shown in FIG. 1.
Figure 3:
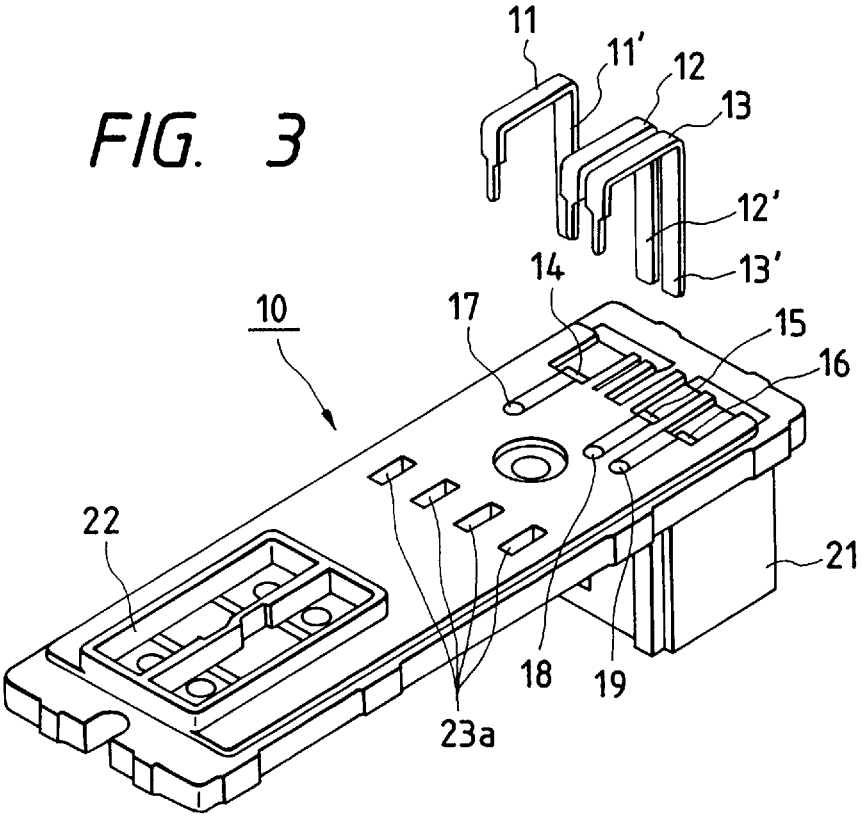
FIG. 3 is a perspective view showing the insert molding and metal pieces which are press-fitted therein.
Figure 4:
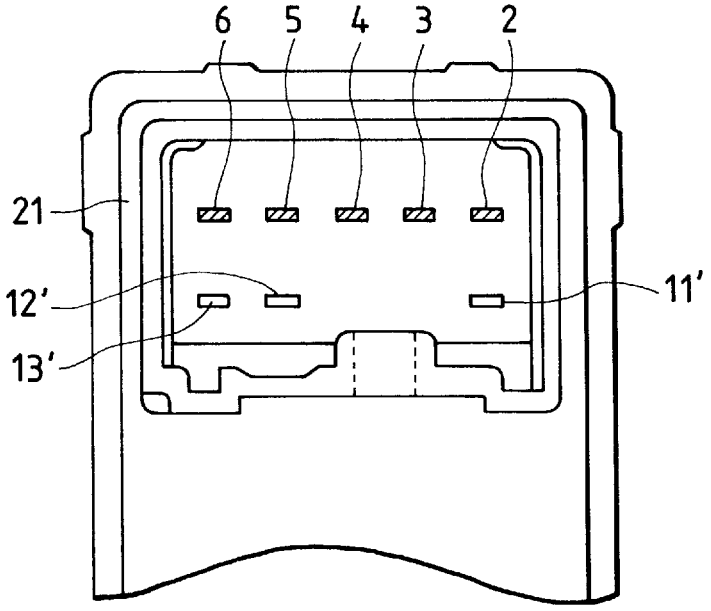
FIG. 4 is a bottom view of a connector terminal section which is a part of the insert molding.

FIG. 1 is a plan view of a metal stamping which is inserted into an insert molding which is a part of a switch device according to the first embodiment of the invention. FIG. 2 is a perspective view of the metal stamping. FIG. 3 is a perspective view showing the insert molding and metal pieces, different from the metal stamping, which are press-fitted therein. FIG. 4 is a bottom view of connector terminals fixed to the insert molding.

A metal stamping 1 as shown in FIGS. 1 and 2 is formed by blanking a metal plate in such a manner that it has a first group of connector terminals 2, 3, 4, 5 and 6 arranged in one of the two lines in which a number of connector terminals are arranged, and a wire pattern 7 to which switches (described below) are connected. The connector terminals 2 through 6 are large current terminals. A number of metal stampings may be formed one after another by blanking a belt-shaped metal plate.

The metal stamping 1 is insert-molded by an insert molding cavity for resin molding to obtain an insert molding 10 as shown in FIG. 3. Metal pieces 11 to 13 are each U-shaped so as to have two legs, namely, a long leg and a short leg. The metal pieces 11 to 13 are formed independently from the metal stamping 1. The long legs of the metal pieces 11 to 13 serve as connector terminals 11', 12' and 13' arranged in the other line, respectively. That is, the metal pieces 11 to 13 have the connector terminals 11' to 13' of a second group, respectively. Those connector terminals 11' to 13' are small current terminals, and are press-fitted into holes 14, 15 and 16, respectively, which are formed in the insert molding 10. On the other hand, the short legs of the metal pieces 11, 12, and 13 are press-fitted into holes 17, 18 and 19, respectively, which are formed in the insert molding 10, so that they are electrically connected to the wiring pattern and other circuit boards. In the embodiment, the short legs are connected to a circuit board 20 (FIG. 5) which is mounted on the lower surface of the insert molding 10.

The terminals (long legs) 11', 12' and 13' of the metal pieces 11, 12 and 13, which are press-fitted in the holes 14, 15 and 16, respectively, are extended through parts a, b and c (FIG. 2) of the metal stamping 1. The short legs of the metal pieces 11, 12 and 13, which are press-fitted in the holes 17, 18 and 19, respectively, are extended through parts d, e and f (FIG. 2) of the metal stamping 1. As shown in FIG. 3, a tubular wall 21 is extended from the lower surface of the insert molding 10 in such a manner that it surrounds the connector terminal section. A switch mounting area is provided in the upper surface of the insert molding 10. In addition, the insert molding 10 has a plurality of holes 23*a* which are formed by removal of the portions 23 (FIG. 1) of the metal stamping during insert molding. The terminals 2, 3, 4, 5 and 6 in the one line (or the large current terminals 2 through 6) and the terminals 11', 12' and 13' in the other line (or the small current terminals) are arranged as shown in FIG. 4. Those connector terminals 2 to 6, and 11' to 13' are the male terminals through which a plurality of external loads are connected to switches adapted to control those loads.

Figure 5:
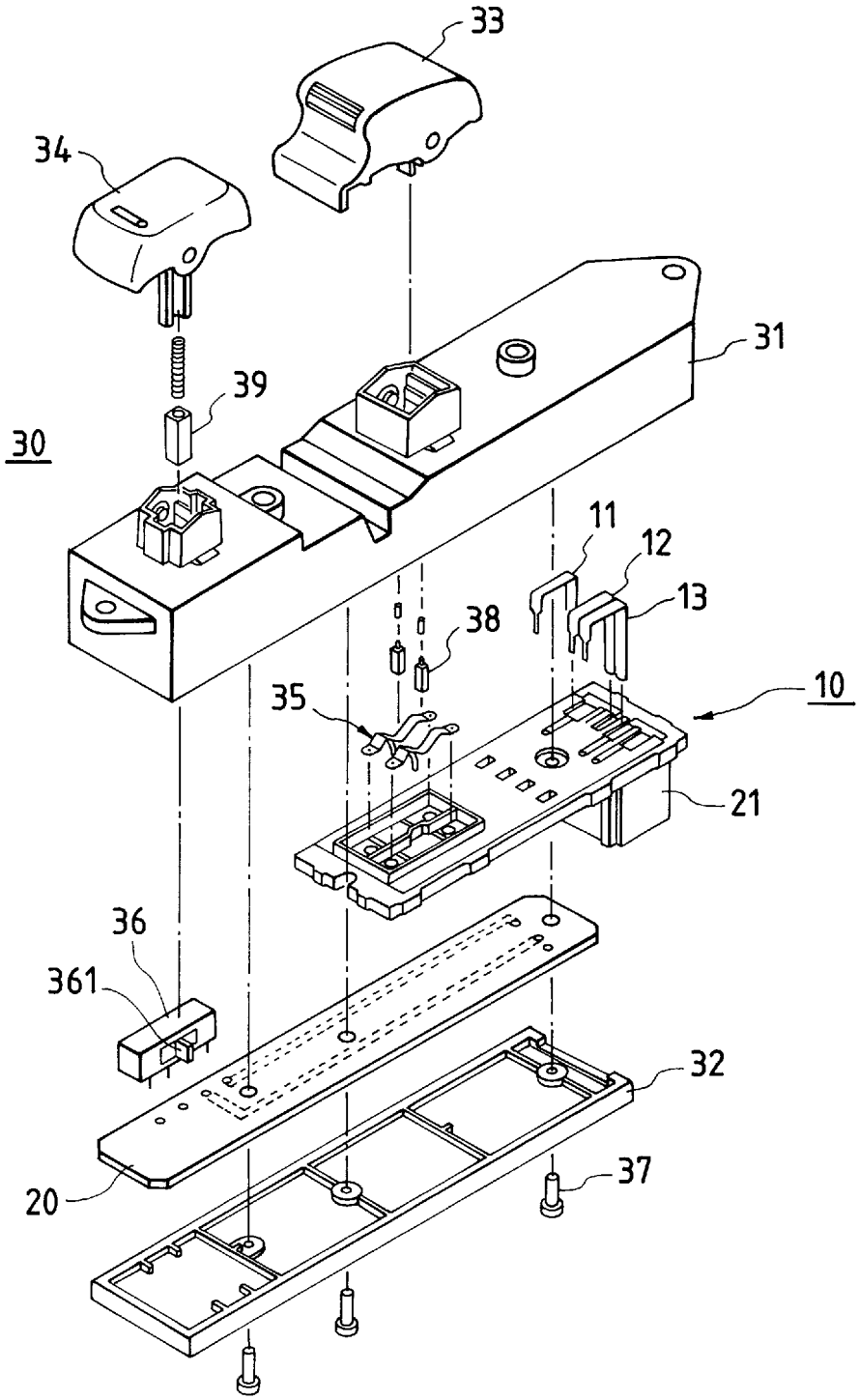
FIG. 5 is an exploded perspective view of the switch device incorporating the insert molding.

FIG. 5 is an exploded perspective view showing the switch device 30 according to the invention, which is made up of the above-described insert molding 10 and circuit board 20. The switch device 30, as shown in FIG. 5, is constituted by a casing 31 in which the insert molding 10 is built; a cover 32 which covers the bottom of the casing 31; and operating knobs 33 and 34 which appear in the upper surface of the casing 31 and are used to operate a movable plate 35 and switch 36 (described below), respectively. The moveable plate 35 and switch 36 are arranged on the insert molding 10 and the circuit board 20, respectively. The movable plate 35 is engaged with a plunger 38 assembled to the knob 33. An operating piece 361 of the switch 36 is engaged with an operating stem 39 that extends downwardly from the operating knob 34. The terminals of the switch 36 are electrically connected to a circuit pattern printed on the rear surface of the circuit board 20. In the embodiment, the terminals of the moveable plate 35, which is operated with the operating knob 33, correspond to terminals 2, 3, 4, 5 and 6; while the terminals of the switch 36, which is operated with the operating knob 34, correspond to the terminals 11', 12' and 13'.

The operating knobs 33 and 34 are swingably mounted on the casing 31 through shafts which are extended perpendicular to the longitudinal direction (or the front-to-rear direction) of the casing. Each of the knobs 33 and 34 has a so-called "click mechanism" with which, when the knob is swung in a direction to some extent, it is caused to automatically swing in that direction. As the operating knobs 33 and 34 are turned, the switches 35 and 36 are turned on and off, and the "on" and "off" signals of those switches are transmitted through the connector terminals to control circuits (not shown) such as for instance an electric motor control circuit. In the embodiment, the operating knob 33 is for a power window; that is, it actuates an electric motor to open and close a window of a motor vehicle. The operating knob 34 is to turn on and off a door locking mechanism of the motor vehicle. The cover 32 together with the insert molding 10 and the circuit board 20 is secured to the casing 31 with screws 37. The casing 31 is mounted in a recess formed in the arm rest of a door of a motor vehicle in such a manner that the top of the casing 31 is exposed. The connector terminals exposed below the casing 31 (which are surrounded by the tubular wall 21) are engaged with female terminals (not shown) which are connected through a cable to external loads.

Figure 6:
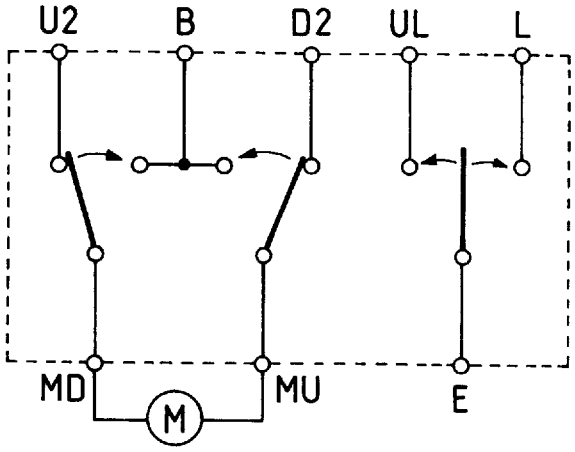
FIG. 6 an electrical circuit diagram of the switch device.

FIG. 6 is an electrical circuit diagram of the switch device 30 shown in FIG. 5. The moveable plate 35 is connected to a power circuit provided for an electric motor M which is adapted to open and close a window of a motor vehicle, and the switch 36 is connected to a power circuit provided for a door locking mechanism of the motor vehicle, to control the operation of the door locking mechanism.

Second Embodiment

Figure 7:
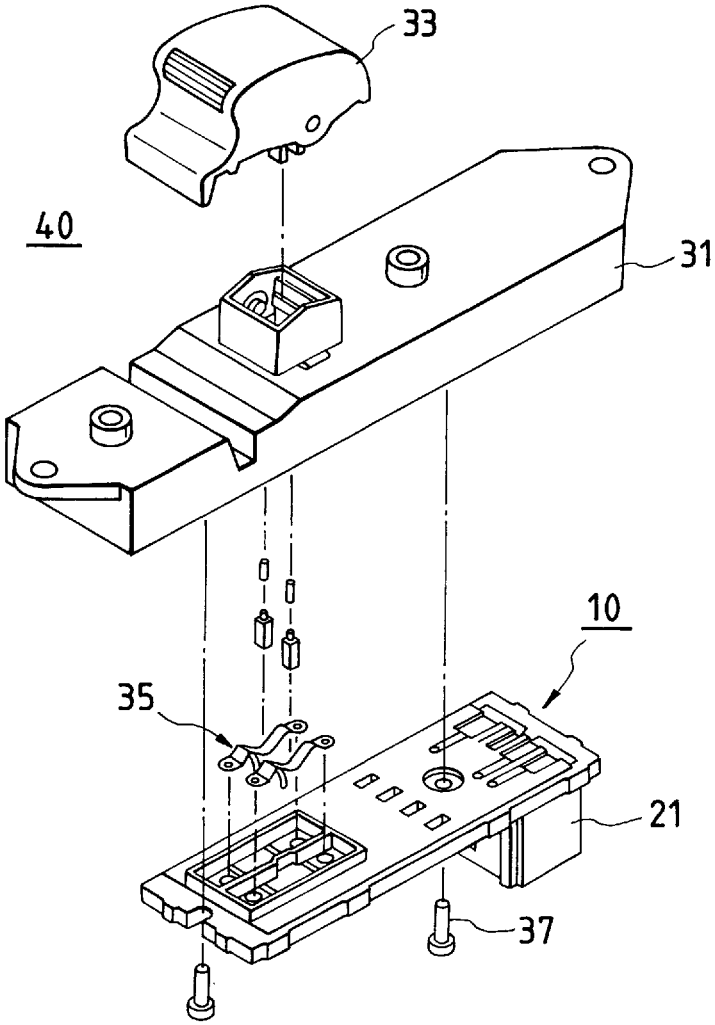
FIG. 7 is an exploded perspective view of the switch device of a second embodiment of the invention.

FIG. 7 is an exploded perspective view showing the arrangement of the switch device according to a second embodiment of the invention. The switch device 40 has no operating knob for the door locking mechanism, and has only one operating knob 33 to control the power window. In the second embodiment, the insert molding 10 is the same as the above-described one, and has the terminals 2, 3, 4, 5 and 6 of the metal stamping. However, in the second embodiment, unlike the first embodiment, it is unnecessary for the insert molding 10 to have the connector terminals (or small current terminals) 11', 12' and 13' of the metal pieces 11, 12 and 13. That is, the second embodiment and the first embodiment employ the same inserting molding, but are different from each other in the purpose of use (or in the type of operation). In other words, the second embodiment has no door-locking-mechanism operating knob, and accordingly it is unnecessary to press-fit the metal pieces 11, 12 and 13 into the insert molding 10.

As was described above, in the embodiments of the invention, the connector terminals 2 through 6 of the metal stamping 1 are subjected to insert molding to form the insert molding 10, and the remaining terminals 11' to 13' are press-fitted in the insert molding 10. Accordingly, a switch device with the connector terminals arranged in plural lines is provided. This feature makes it possible to simplify the stamping metal mold and the insert-molding and accordingly to reduce the manufacturing cost of the switch assembly. And even a switch device in which it is unnecessary to arrange connector terminals in plural lines, can employ the same insert molding 10 although, in that case, the metal pieces 11, 12 and 13 are not press-fitted therein.

While the preferred embodiments of the invention have been described, it will be obvious to those skilled in the art that various changes and modifications may be made therein without departing from the invention. For instance, in the above-described embodiments, the connector terminals are exposed below the casing 31; however, the technical concept of the invention is applicable to a switch device in which its terminals protrude from the sides of the switch device, or from the front and the rear.

According to the present invention, among the connector terminals arranged in plural lines, the first group of connector terminals in one line are parts of the metal stamping, and the second group of connector terminals in another line are parts of metal pieces which are different from the metal stamping. Hence, in the switch device of the invention, when compared with a switch device in which connector terminals are arranged in plural lines and are parts of one metal stamping, the manufacture of its metal stamping requires less bending steps, and creates wasteful portions. Furthermore, the metal stamping can be formed with a simple stamping metal mold. And even in the case where there are two kinds of switch devices—a first switch device in which connector terminals are arranged in one line, and a second switch device in which connector terminals are arranged in two lines, the insert molding can be commonly applied to those switches, which contributes to a reduction in the manufacturing cost of the switch device.

In addition to the above-described effects, as for a switch which needs not employ the small current terminals, it is unnecessary to press-fit the small current terminals in the insert molding, and, therefore, the insert molding can be used commonly for two kinds of switches—one that needs the small current terminal, and the other that does not.

In addition to the above-described effect, in the switch device, the insert molding is simplified in construction, and it can be formed with a simple insert-molding metal mold. This means that the molding cycle is shortened, and the switch device has reduced manufacturing costs.

Furthermore, the switch device may be employed as a power window switch having a plurality of operating knobs which is simple in construction and small in size. This feature results in a great reduction in the manufacturing cost of the switch device.

What is claimed is:

1. A switch device comprising:

a plurality of switches which control a plurality of external loads, wherein said plurality of switches comprise a first switch and a second switch;

a casing which accommodates said plurality of switches therein;

operating members which operate said plurality of switches, said operating members located at an upper surface of said casing; and a plurality of connector terminals through which said plurality of switches are electrically connected to at least one of said plurality of external loads, said plurality of connector terminals being arranged in plural lines in a lower surface or in a side surface of said casing;

wherein said plurality of connector terminals arranged in plural lines further comprise, a first group of said connector terminals formed in one line and connected to a wiring pattern, said first group of connector terminals and said wiring pattern formed by one metal stamping, and a second group of said plurality of connector terminals formed in a second line and constructed by metal pieces separate from said metal stamping, said second group of connector terminals being electrically connected to said second switch, wherein said metal stamping and said metal pieces are formed independently and are accommodated in said casing.

2. A switch device as claimed in claim 1, wherein said first group of said connector terminals are employed as large current terminals, and said second group of said connector terminals are used as small current terminals.

3. A switch device as claimed in claim 2, wherein said first group of said connector terminals are subjected to insert molding to form an insert molding, and said second group of said connector terminals are press-fitted in said insert molding.

4. A switch device as claimed in claim 1, wherein at least one of said plurality of external loads is a power window of a motor vehicle, and another is a door locking mechanism of said motor vehicle.

5. A switch device for use in a motor vehicle comprising:

switching means for controlling at least one of a plurality of electrical loads of said motor vehicle;

a casing which accommodates said switching means therein;

operating means for operating said switching means, wherein said operating means has at least one operating member located at an upper surface of said casing;

a plurality of connector terminals through which said switching means is electrically connected to said at least one electrical load, said plurality of connector terminals being arranged in plural lines at a lower surface or a side surface of said casing and said plurality of connector terminals forming a first line of connector terminals and a second line of connector terminals;

a metal stamping having said first line of connector terminals and a wiring pattern formed thereon, said wiring pattern thereby being electrically connected to said first line of connector terminals, wherein said metal stamping is accommodated in said casing; and a plurality of metal pieces formed separately from said metal stamping and forming said second line of connector terminals;

wherein said first line of connector terminals are employed as large current terminals and said second line of connector terminals are employed as small current terminals.

6. A switch device as claimed in claim 5, wherein said first line of said plurality of connector terminals are insert molded to form an insert molding, and said second line of said plurality of connector terminals are press-fitted in said insert molding.

7. A switch device as claimed in claim 5, wherein at least one of said plurality of electrical loads is a power window of said motor vehicle, and another of said plurality of electrical loads is a door locking mechanism of said motor vehicle, wherein said switching means is electrically connected to said power window of said motor vehicle and said door locking mechanism of said motor vehicle and is fixedly connected to said operating means.

8. A switch device for use in a motor vehicle as claimed in claim 7, wherein said casing is mounted in a recess formed in an arm rest of a door of said motor vehicle in such a manner that said upper surface of said casing is exposed, and said plurality of connector terminals are electrically engaged with female terminals of a cable electrically connected to at least a portion of said plurality of electrical loads of said motor vehicle.

* * * * *